US012410539B2

(12) United States Patent
Norris et al.

(10) Patent No.: US 12,410,539 B2
(45) Date of Patent: Sep. 9, 2025

(54) TOUCH SPINNING

(71) Applicant: Carbon Reform Inc., Wilmington, DE (US)

(72) Inventors: Joanne Norris, Wilmington, DE (US); Nickolas Martin, Philadelphia, PA (US); Prashant Ramesh, Newark, DE (US); Rakesh Ravi, Murrysville, PA (US)

(73) Assignee: Carbon Reform Inc., Wilmington, DE (US)

( * ) Notice: Subject to any disclaimer, the term of this patent is extended or adjusted under 35 U.S.C. 154(b) by 373 days.

(21) Appl. No.: 18/155,613

(22) Filed: Jan. 17, 2023

(65) Prior Publication Data

US 2024/0240361 A1 Jul. 18, 2024

(51) Int. Cl.
*D01D 5/06* (2006.01)

(52) U.S. Cl.
CPC ..... *D01D 5/06* (2013.01); *D10B 2505/04* (2013.01)

(58) Field of Classification Search
CPC ..... D01F 8/00
See application file for complete search history.

(56) References Cited

U.S. PATENT DOCUMENTS 11,001,943 B1 * 5/2021 Tokarev ..... D01D 5/098
2009/0025555 A1 1/2009 Lively et al.
2018/0243682 A1 8/2018 Isobe et al.
2019/0352803 A1 * 11/2019 Sharma ..... D02G 3/38
2021/0246575 A1 * 8/2021 Yadavalli ..... D01D 5/06

FOREIGN PATENT DOCUMENTS

WO 2020256450 A1 12/2020

OTHER PUBLICATIONS

Chung et al., Development of an omentum-cultured oesophageal scaffold reinforced by a 3D-printed ring: feasibility of an in vivo bioreactor, Artificial Cells, Nanomedicine, and Biotechnology, an International Journal, vol. 46, No. S1, S885-S895, Feb. 2018.
Coleman et al., Touchspinning: Mechanically drawing polyacrylonitrile nanofibers, J Appl Polym Sci., Feb. 2022; 14 pages.
(Continued)

*Primary Examiner* — Jacob T Minskey
*Assistant Examiner* — Virak Nguon
(74) *Attorney, Agent, or Firm* — MLO, a professional corp.

(57) ABSTRACT

Methods and systems include providing a modular frame having a plurality of frame sections that are connectable to each other at a joint area. A pin extends from the joint area of the modular frame. A polymer solution is dispensed through a syringe, and the pin passes by and contacts a droplet of the polymer solution as the modular frame rotates. Fibers are formed by using the pin to draw out the fibers from the droplets of the polymer solution. The fibers are deposited on the modular frame. In some cases, the plurality of frame sections of the modular frame are arranged on a base in a first arrangement. After the fibers are deposited, the plurality of frame sections are reconfigured into a second arrangement different from the first arrangement to form a fiber component of an air flow device.

20 Claims, 13 Drawing Sheets

(56) References Cited

OTHER PUBLICATIONS

Jeong et al., 3D Bioprinting Strategies for the Regeneration of Functional Tubular Tissues and Organs, Bioengineering, 2020, 7, 32, Mar. 2020, 24 pages.
Lee et al., Touch-Spun Nanofibers for Nerve Regeneration, ACS Appl. Mater. Interfaces 2020, 12, Dec. 2019, pp. 2067-2075.
Robinson et al., Comparative analysis of fiber alignment methods in electrospinning, Matter 4, 821-844, Mar. 3, 2021, pp. 821-844.
Tokarev et al., Touch- and Brush-Spinning of Nanofibers, Adv. Mater. 2015, 27, Sep. 2015, pp. 6526-6532.
Zhu et al., Electrospun Fibrous Mats with High Porosity as Potential Scaffolds for Skin Tissue Engineering, Biomacromolecules, vol. 9, No. 7, May 2008, pp. 1795-1801.

* cited by examiner

TOUCH SPINNING

BACKGROUND

Polymer nanofibers are used in many applications such as composite materials, meshes, and biological structures (e.g., tissue scaffolds). Polymer nanofibers are most commonly created through electrospinning, in which a droplet of a polymer is dispensed by a syringe pump and stretched to form a nanofiber due to an electric field between the syringe needle and another electrode that serves as a collector for the fibers. The dimensions and mechanical properties of the fibers can be customized by controlling parameters such as the flow rate of polymer solution through the syringe pump, voltage applied, and rotation speed of the collector. In some examples, three-dimensional tissue scaffolds have been created by collecting the nanofibers on mandrels shaped for the desired geometry, such as cylindrical rods, flat discs, or cones.

Another type of technique that has been more recently developed is touch spinning in which a touch rod touches a droplet of polymer solution from a syringe and mechanically stretches the polymer to form a nanofiber. The rod is mounted on a rotating base, where the rotating motion causes the rod to repeatedly contact droplets from the syringe and pull the polymer to form nanofibers. The fibers are deposited on a collecting structure such as a post, spool, glass slide, or frame. Nanofiber characteristics can be customized through altering parameters such as the feed rate of the polymer solution, rotation rate of the base, and distance between the syringe and the collecting structure. In some examples, multiple syringes with different polymer solutions, each with a corresponding touch rod, can be included in a touch spinning system which can be utilized to create nanofibers with a blend of polymers.

Brush spinning is a variation of touch spinning where a round hairbrush is positioned over a film. A polymer solution is poured on the film, and when the brush is rotated, brush filaments touch the solution to create nanofibers that are collected onto the hairbrush. The fibers are then removed from the hairbrush for use in their end application.

SUMMARY

In embodiments, a method of forming a fiber component, such as of an air flow device, includes providing a modular frame that comprises a plurality of frame sections, wherein adjacent frame sections of the plurality of frame sections are connectable to each other at a joint area, and wherein a pin extends from the joint area of the modular frame. The method may also include arranging the modular frame on a base in a first arrangement of the plurality of frame sections; dispensing a polymer solution through a syringe; rotating the base and the modular frame such the pin passes by and contacts a droplet of the polymer solution as the modular frame rotates; forming fibers by using the pin to draw out the fibers from the droplet of the polymer solution; and depositing the fibers on the modular frame. After the depositing, the method may include reconfiguring the plurality of frame sections into a second arrangement different from the first arrangement to form the fiber component of the air flow device.

In embodiments, a method of touch spinning fibers includes providing a modular frame that comprises a plurality of frame sections, wherein frame sections of the plurality of frame sections are releasably connectable to each other by a connection element at a joint area of the modular frame, and wherein a pin extends from the joint area. The method may also include dispensing a polymer solution through a syringe; rotating a base with the modular frame coupled onto the base such the pin passes by and contacts a droplet of the polymer solution as the modular frame rotates; and forming a fiber component of an air flow device. The fiber component comprises the frame section and a mat of the fibers, the fibers being drawn out from droplets of the polymer solution by the pin in the modular frame and deposited on the frame section.

In embodiments, a system for forming a fiber component, such as of an air flow device, includes a modular frame having a plurality of frame sections, wherein frame sections of the plurality of frame sections are connectable to each other by a connection element at a joint area. The system may also include a pin extending from the joint area, near a top edge of the modular frame; a base configured to be coupled to the modular frame at a bottom edge of the frame section, the bottom edge being opposite the top edge; a rotation device configured to be coupled to the base; and a syringe positioned such that the pin passes by and contacts a droplet dispensed from the syringe when the base and the modular frame are rotated by the rotation device.

DETAILED DESCRIPTION

The present disclosure describes systems and methods for touch spinning, such as for forming a fiber component of an air flow device. Embodiments involve touch spinning directly on frames, where the frames include a touch component that draws out fibers, such as nanofibers. The frames can be sections of an overall modular frame, where the modularity enables the frame sections to be configured as needed during manufacturing and in an end product. In some cases, the touch component of the frame is a pin extending from a joint area between adjacent frames in the modular frame.

Touch spinning methods and systems are disclosed that improve manufacturing time, enable flexibility in manufacturing and product configurations, and provide improved functionality of an end product compared to conventional spinning techniques. For example, instead of using a touch component to draw out fibers and then depositing fibers onto a separate component, in the present disclosure the touch component is part of a collection assembly (i.e., modular frame) itself during the spinning process. The pins can be removed from the modular frame before using the modular frame as an end product, such as part of an air flow device. Directly forming fibers on an end-use frame reduces manufacturing time and cost and improves the integrity of the component compared to making fibers and then constructing an end use item from the fibers.

In this disclosure, fibers that are formed can be "nanofibers," such as having diameters of 1 nm to 1000 nm, or "microfibers," such as having diameters of 1 μm to 10 μm. Embodiments that refer to nanofibers may equally apply to microfibers or vice versa. Systems and processes disclosed herein may produce nanofibers, microfibers, or a combination thereof. Also in this disclosure, a "mat" of fibers is a free-standing piece comprised of packed fibers, such as densely packed fibers, in any configuration.

Figure 1:
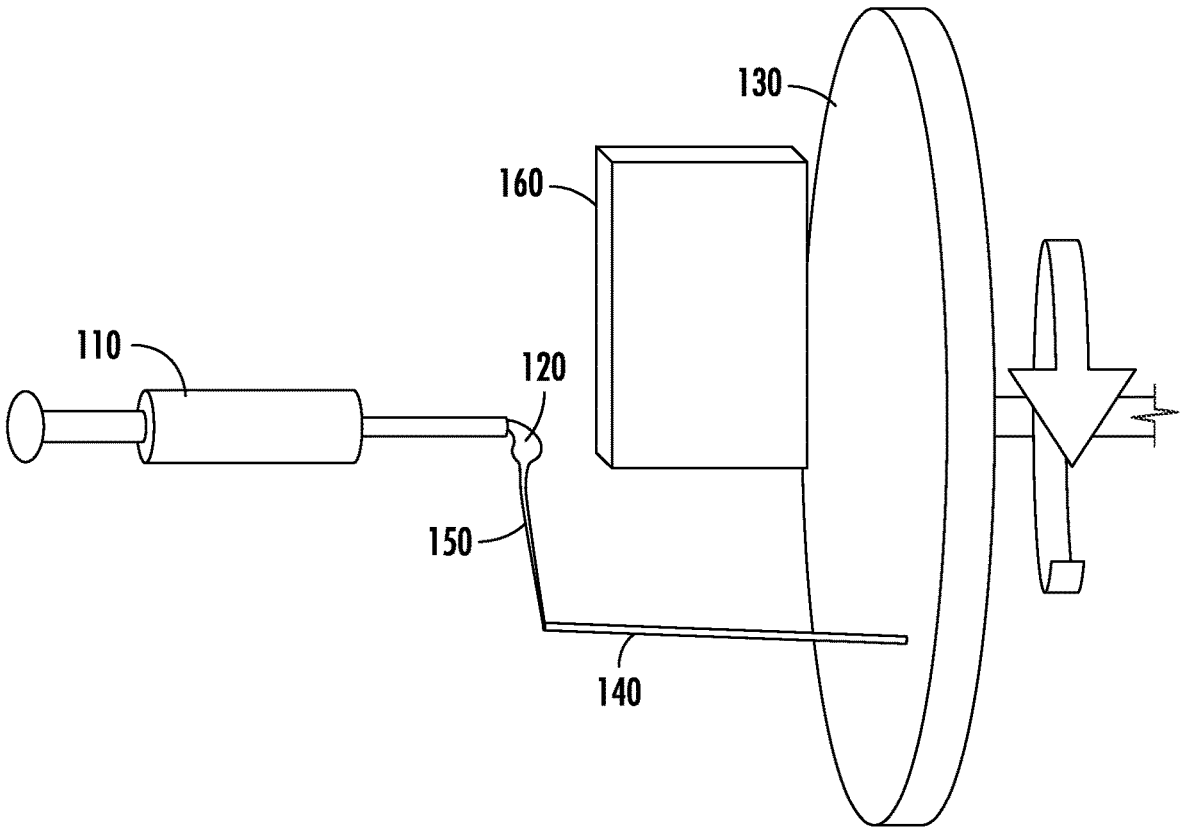
FIG. 1 PRIOR ART
FIG. 1 is a perspective view of a conventional touch spinning apparatus, as known in the art.

In conventional touch spinning technology illustrated in FIG. 1, a syringe pump 110 holding a polymer solution slowly dispenses a droplet 120 of the polymer solution. A spinning wheel 130 having an elongated rod 140 (i.e., thin post) extending from it rotates at a high speed. The rod 140 serves as a touch component that makes contact with the droplet 120 coming out of the syringe pump 110, drawing out very thin fibers 150, e.g., microfibers and/or nanofibers. A glass slide 160 or other collection component sits within the spin radius of the rod 140 (which is stationary relative to the spinning wheel 130) so that the drawn-out fibers 150 collect or wrap themselves around the slide 160. In some cases, the fibers are utilized by unwinding the fibers off the slide 160 for incorporation into the desired end-use product. In other cases, nanofibers have been formed into a desired shape during the touch-spinning. For example, meshes for biological tissue scaffolds have been created by touch spinning nanofibers onto a frame, then turning the frame 90° and performing more touch spinning to form a nanofiber mesh.

Figure 2:
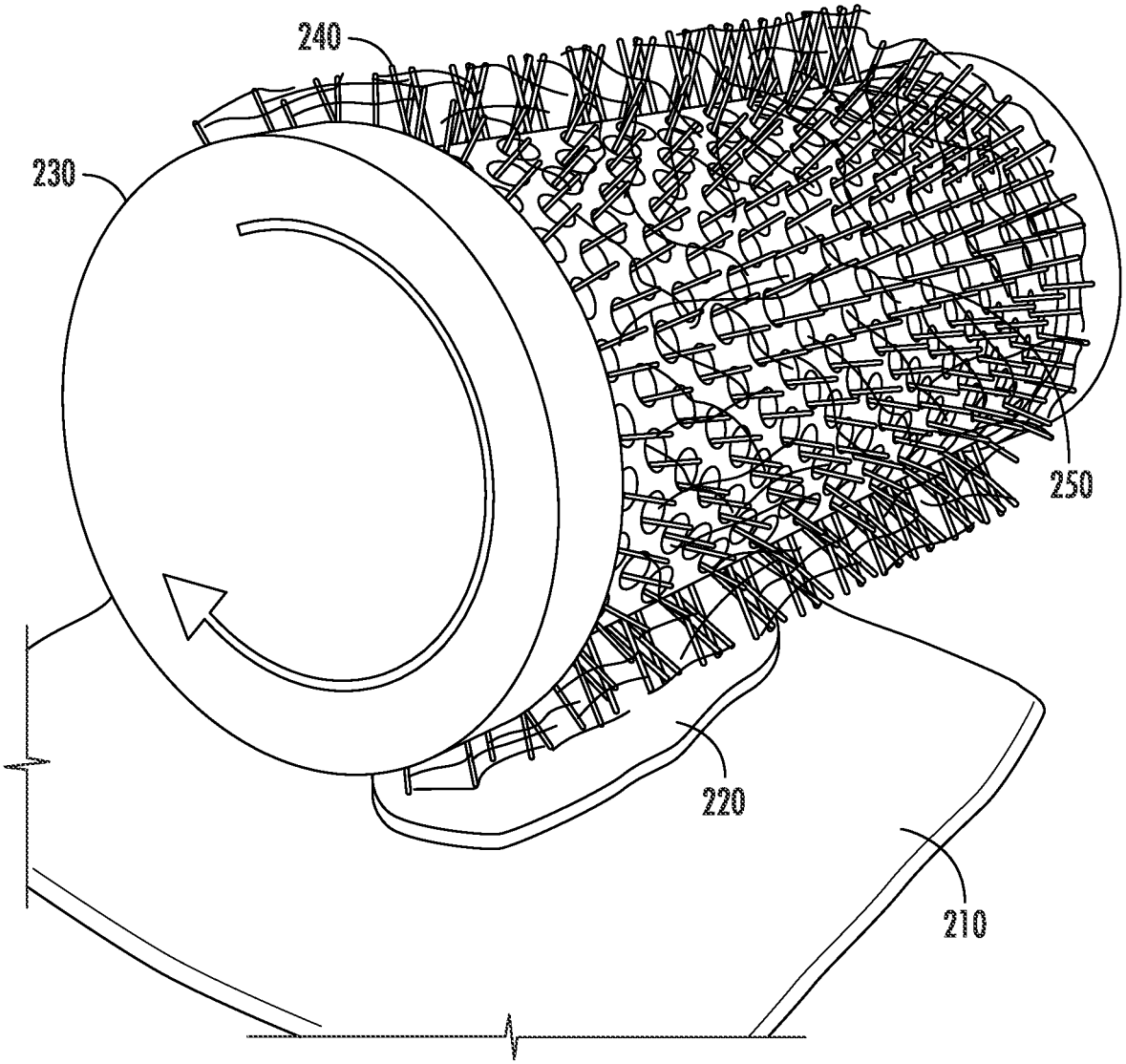
FIG. 2 PRIOR ART
FIG. 2 is a perspective view of a conventional brush spinning apparatus, as known in the art.

In conventional brush spinning as illustrated in FIG. 2, brush elements 240 on a brush 230 serve as multiple touch components. The brush elements 240 contact a polymer solution 220 on a plate 210. When the brush 230 rotates, the polymer is pulled by the brush elements 240 to form fibers 250 that wrap around the brush 230. However, it is difficult to remove the fibers 250 in an intact manner from the brush 230, such as in one sheet, because the brush elements 240 prevent the fibers 250 from being easily removed.

Figure 3:
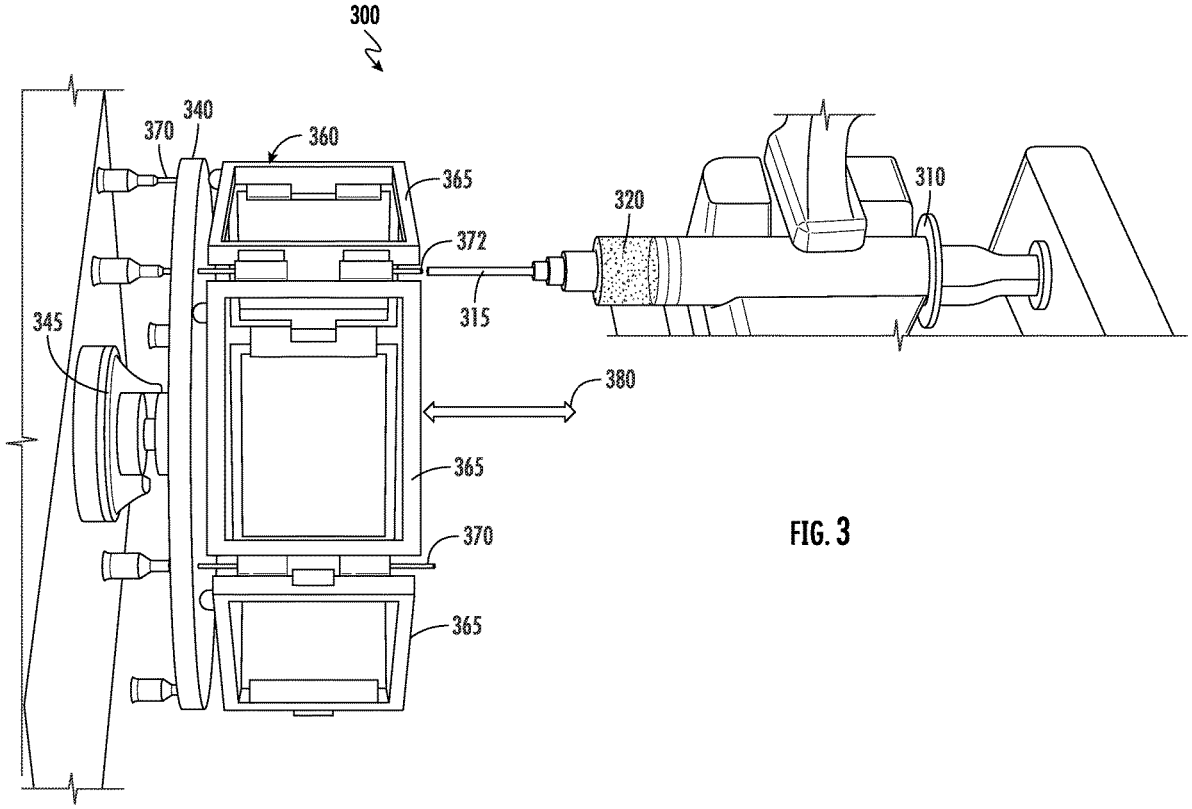
FIG. 3 is a side perspective view of a touch spinning system, in accordance with some embodiments.

FIG. 3 shows an embodiment of a touch spinning system 300 of the present disclosure, utilizing a modular frame 360 having a plurality of frame sections 365 connected together. In this embodiment, the frame sections 365 are coupled to each other at joint areas by pins 370. The modular frame 360 is mounted on a base 340 that is rotated by a rotation device 345 (e.g., a motor). In this example, base 340 has holes through which pins 370 can inserted, to mount modular frame 360 to base 340. The base 340 is configured as a solid circular plate in this example. A syringe 310 (e.g., a syringe pump) holds a polymer solution 320, dispensed through a tube 315 (e.g., a needle) extending from the tip of syringe 310. The pins 370 extend toward the syringe 310, oriented so that as the modular frame 360 rotates, the pins 370 pass by the syringe 310, and a tip 372 of the pin 370 contacts droplets of the polymer solution dispensed from the tube 315 of syringe 310. The pins 370 (i.e., a needle or thin rod) may be made of a metal such as stainless steel or aluminum. Example diameters of pins may be, for example, 0.1 mm to 2.0 mm, such as 1.0 mm.

As each pin 370 moves away from the syringe 310 after contacting a droplet, the pins cause fibers (e.g., nanofibers and/or microfibers) to be formed by drawing out the fibers from the droplets of the polymer solution. The spinning movement of the modular frame 360 creates air flow, such as a vortex, that moves the fibers such that they are deposited onto and across the frame sections 365. Because the pins 370 are part of the modular frame 360 during the spinning process, rather than being a separate piece from the collection component as in conventional touch spinning, the tip 372 of each pin 370 (i.e., the contact point to the polymer droplet) is in close proximity to the frame sections 365 and facilitates depositing the formed fibers on the frame.

In some cases, the location of the pins 370 relative to the frame sections 365 and/or the rotation speed of the modular frame 360 can be adjusted to tailor characteristics of the fibers deposited on the frame sections 365. For example, only a single pin 370 may be included in the modular frame 360, or more than one pin may be present in the modular frame, such as a pin 370 at each joint area between frame sections 365. Having more pins may create more dense fiber mats or may reduce manufacturing time compared to less pins.

In some examples, the rotation speed of the base 340 can be varied (e.g., increasing and/or decreasing the speed) during the touch spinning process to influence the diameters of the produced fibers. In some cases, the modular frame can be moved axially toward or away from the syringe 310 (and tube 315) as indicated by arrow 380 to adjust where the fibers are deposited on the modular frame 360. For example, moving the modular frame 360 more toward the syringe 310 can cause fibers to be deposited toward the bottom edge of the frame sections 365, near the base 340. Moving the modular frame 360 away from the syringe 310 can cause fibers to be deposited toward the top edge of the frame sections 365, and other positions toward or away from the syringe can fill in fiber coverage between the top edge and bottom edge to form a mat of fibers across the frame. The placement locations of the fibers may also be affected by the orientation of the modular frame 360, such as if the modular frame is rotating on a horizontal or vertical axis. In different positions of the modular frame 360 relative to the syringe 310, the distance that the pins 370 extend out from the frames can be adjusted as needed to properly contact the droplets from the syringe. In some examples, there may be a pin at each joint area, where the pins may be the same or different lengths from each other. Pins of different length may be utilized such that certain pins make contact with the droplet(s) from the syringe(s) in a particular position of the modular frame relative to the syringe during spinning (e.g., axial position as described above), and other pins make contact with the droplet(s) in a different position of the modular frame relative to the syringe.

In some cases, the frame section 365 with the fibers formed on it, such as a nanofiber mat, can be used as a final product as is, or as a component of a product as is. As an example, a fiber-coated frame section 365 (with fibers on the front and/or back of the frame section 365) can be an air flow component (or a sub-assembly of an air flow component) of an air flow device, such as a sorbent material for a filtration system or carbon dioxide capture system. Forming fibers directly on a component of an air flow device can save manufacturing time and cost compared to forming a fiber mat and then assembling it onto a separate structure. The direct deposition of fibers onto the frame section can also improve functionality and integrity of the end-use product by having the fibers already attached to the frame and by not needing to disturb the fibers by having to move them for further manufacturing. In other examples of the present disclosure, the fibers can be removed from the frame section (e.g., cutting a fiber mat off the frame) and used in an end-use product separately from the frame.

Figure 4A:
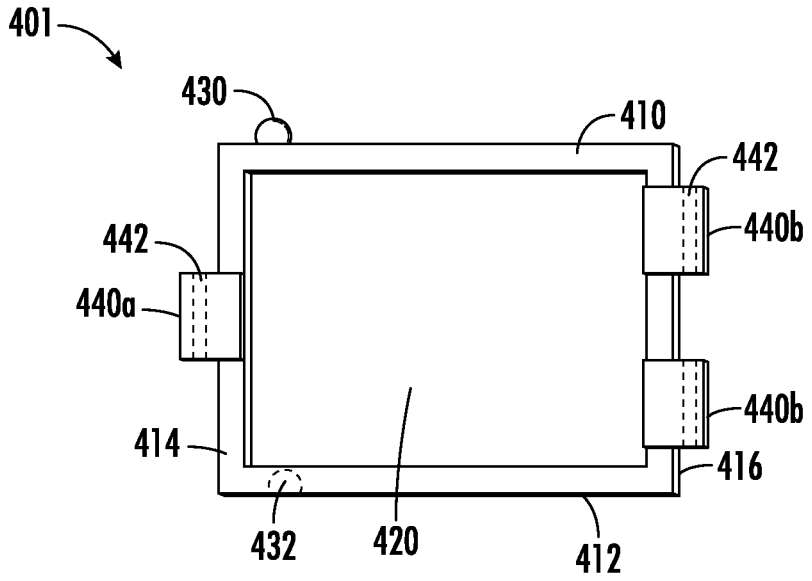
FIG. 4A is a front view of a frame section for a touch spinning system, in accordance with some embodiments.

Frame sections can be used individually in fiber spinning or in a group, where consecutive frame sections can be linked together. FIG. 4A shows an individual frame section 401, in accordance with some embodiments. Although the frame section 401 is shown as rectangular, other shapes are possible such as an oval or polygon. The frame section 401 can be made of various materials such as metals, plastics, composite materials, or combinations thereof. Since no voltage needs to be applied as is required in electrospinning, the frame section 401 can be made of an electrically insulating (i.e., non-conducting) material. In some examples, the frames can be made by 3D-printing (i.e., additive manufacturing). Dimensions of the frame can be customized for the end application product. In one example, the frame section 401 may have a size of 2 inches by 3 inches (approximately 5 cm by 7.6 cm) for a total surface area of 12 $in^2$ (approximately 77 $cm^2$) from both sides of the frame. In other examples, frame sections may have a total area of 3 $in^2$ to 192 $in^2$ (approx. 19 $cm^2$ to 1239 $cm^2$), such as up to an 8 inch by 12 inch frame (approx. 20 cm by 30.5 cm) or more.

Frame section 401 has a top edge 410, a bottom edge 412, and two lateral edges 414 and 416. When frame section 401 is mounted in touch spinning system 300 of FIG. 3, the top edge 410 is toward the syringe 310. The top edge 410 is opposite bottom edge 412, and bottom edge 412 is mounted on the base 340 such as using pins 370 of FIG. 3 or other mechanism as described herein. The edges 410, 412, 414 and 416 surround an open space 420 that fibers will be laid across, anchoring the fibers on one or more of the edges. In some cases, fibers will be deposited within the open space 420 and/or around one or more of the edges 410, 412, 414 and 416. The fibers can form a mat, where the mat can be removed to use on its own. In other cases, depending on the application, the mat of fibers may be kept on the frame section after manufacturing and the entire assembly used as a fiber component, such as in an air flow device.

Also included in frame 401 is a protrusion 430 that is on the top edge 410 in this example. Bottom edge 412 has a corresponding notch 432 (i.e., a recess, groove, indentation), where the protrusion 430 is configured to be seated into notch 432, such as by a snap fit or a press fit. The protrusion 430 and notch 432 can be used to stack frame sections together, as shall be described in relation to FIG. 4C. Protrusion 430 is located near or toward an end of the top edge 410 in this example, but in other examples, the protrusion 430 may be located anywhere along top edge 410. In some examples, more than one protrusion 430 may be along top edge 410. In some embodiments, each frame section of a modular frame can have a protrusion, while in other embodiments, only some of the frame sections can have a protrusion (e.g., every other frame section). Similarly, one or more notches 432 can be positioned at various locations on a frame section (or on certain frame sections but not others) corresponding to the protrusions 430 of the modular frame assembly to which the notches 432 are to be mated.

The protrusion 430 is shaped as a spherical dome in this embodiment but may be other shapes. In various examples, the protrusion 430 may be rounded or angular such as having a spherical, hemispherical, conical, pyramidal, prismatic, or cylindrical shape, or any combination thereof. The protrusion 430 and corresponding notch 432 may also include features to help secure frame sections together, such as releasable locking tabs.

Connection elements 440*a* and 440*b* are incorporated on lateral edges 414 and 416, respectively, to enable multiple frame sections 401 to be joined together. In some examples, frame sections 401 are releasably connectable to each other by connection elements 440*a* and 440*b*. In the embodiment of FIG. 4A, the connection elements 440*a-b* are configured as rectangular tabs that extend laterally from the edges 414 and 416, where each tab has a through-hole 442 along its length so that a pin can be inserted. For example, connection elements 440*a* and 440*b* may be configured as tabs coupled to a lateral edge of the frame section, the tabs having through-holes parallel to the lateral edge. In FIG. 4A, one connection element 440*a* is near the center of the left-hand edge 414, and two connection elements 440*b* are in upper and lower regions of the right-hand edge 416. In this manner, neighboring frame sections 401 can be joined in series, with the connection element 440*a* of one frame fitting between connection elements 440*b* of the next frame. Moreover, identical frame sections 401 can be used to assemble an overall modular frame.

In some examples, one or more connection elements 440*a-b* can be included on each lateral edge 414 or 416. In some examples, the connection elements 440*a-b* can be arranged to fit together in an alternating fashion as shown in FIG. 4A (e.g., connection element on one frame fitting between connection elements on a neighboring frame), or a non-alternating fashion (e.g., one or more connection elements on one frame that are not interspersed between elements of a neighboring frame).

Figure 4B:
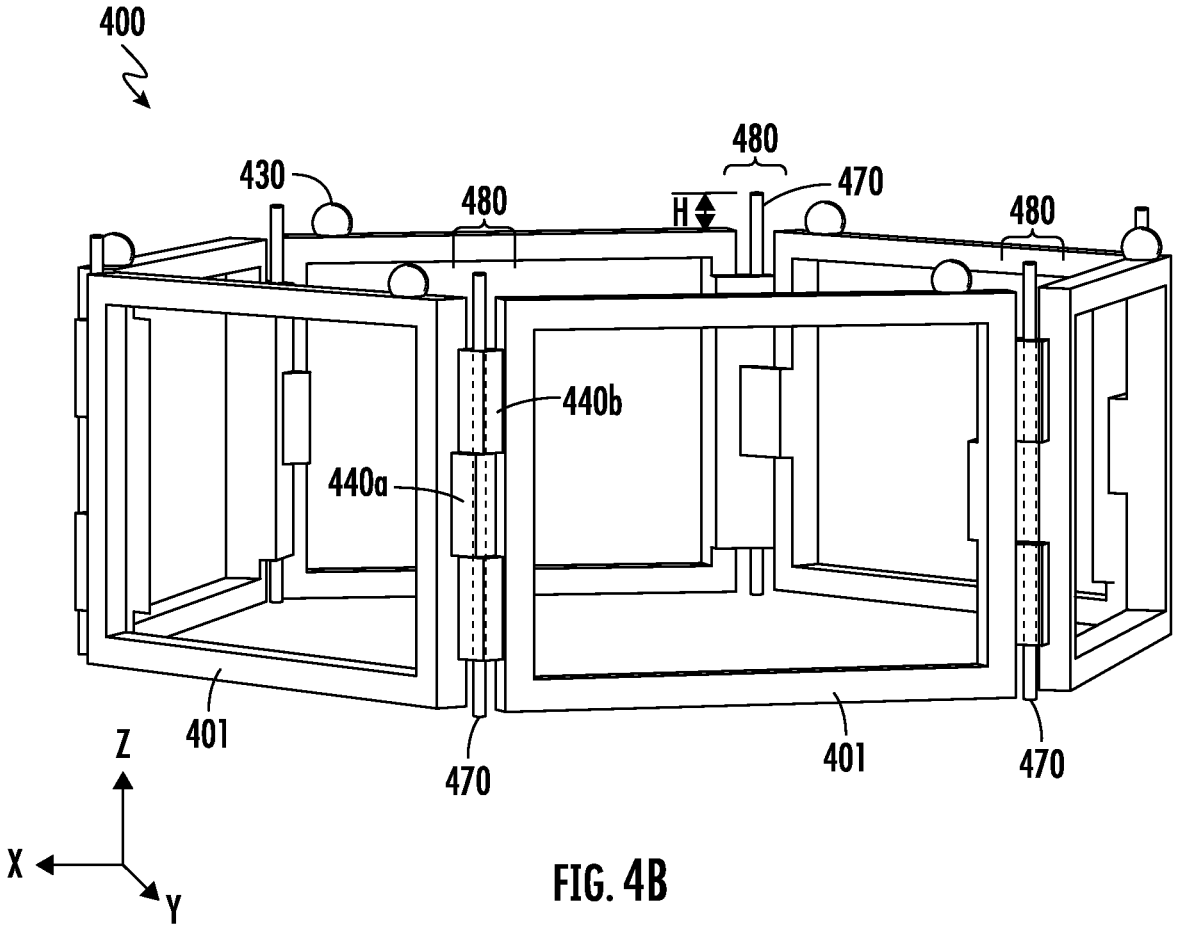
FIG. 4B is a perspective view of a modular frame comprising a plurality of frame sections, in accordance with some embodiments.

FIG. 4B shows a plurality of frame sections 401 connected together by pins 470 through connection elements 440*a-b* to create a modular frame 400. The pins 470 and connection elements 440*a-b* are in a joint area 480 between adjacent frame sections. Pins 470 enable frame sections 401 to be easily released from each other, allowing for modular reconfiguration of the modular frame 400. In this embodiment, there are six frame sections 401 linked in a ring to form a 3-dimensional hexagonal prism. Fewer or more sections can be utilized in other embodiments, such as three sections to form a triangular ring, four sections to form a square ring, or eight sections to form an octangular ring. In some cases, from 1 to 50 (e.g., a stack of 8 hexagonal rings for a total of 48 frame sections), or from 1 to 10, or from 4 to 20 frame sections can be coupled together to form a modular frame. In some examples, the frame sections in a modular assembly can be different from each other in size and/or shape. For instance, some frame sections 401 may be longer or shorter rectangles than other frame sections in the modular frame 400.

As described earlier, the pins 470 also serve as touch components for drawing out polymer solution to form fibers. The height "H" that each pin 470 extends past the top edge of the frame section 401 can be configured according to the location of the polymer dispensing syringe during manufacturing. In some examples, a plurality of pins 470 may be present, such as at each joint area 480. In other examples, a pin 470 may be present only at one joint area 480, or at some but not all of the joint areas 480, where in the joint areas without a pin, other attachment mechanisms can be used to join frame sections together (e.g., hooked elements as described in FIG. 5 below, or other mechanisms such as hinges, clamps, brackets). The number of pins 470 present on a modular frame may be, for example, from 1 to 3, or 1 to 5, or 1 to 10. In some examples, the pins 470 may be positioned to have the same height H extending from the joint areas 480, or may have different heights H to account for the modular frame assembly 400 being at different axial positions (Z-direction) during manufacturing.

Figure 4C:
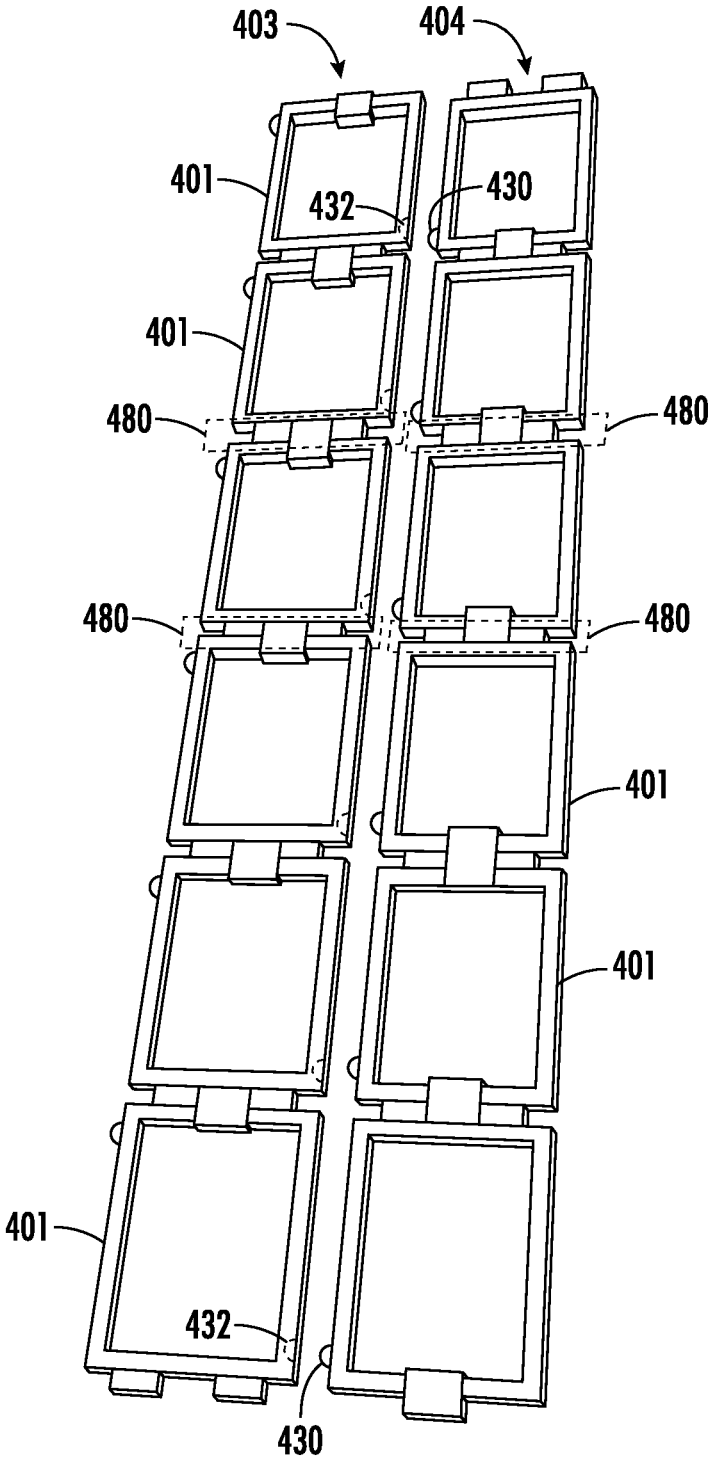
FIG. 4C is a plan view of frame sections being joined together, in accordance with some embodiments.

FIG. 4C shows multiple frame sections 401 being connected together, in accordance with some embodiments. In this figure, two rows 403 and 404 each comprise multiple frame sections 401 connected at joint areas 480, where each row (row 403 and row 404) has six frame sections. The rows are lying next to each other, ready to be stacked together by inserting the protrusions 430 of row 404 into the notches 432 of row 403. In this example, the rows 403 and 404 are linear when being stacked, and then the stacked rows may be formed into a hexagonal ring such as in FIG. 4B by bending the rows at joint areas 480 and then inserting a pin to couple the free ends. In another example, the rows 403 and 404 may first be individually arranged into rings (as shown in FIG. 4B), and then the rings 403 and 404 stacked onto each other by inserting the protrusions 430 into notches 432.

Figure 5:
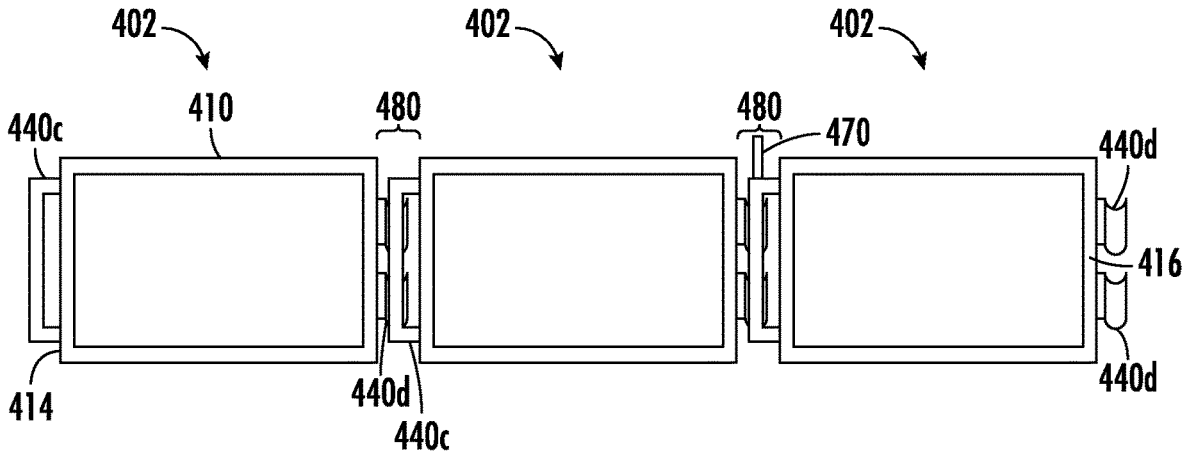
FIG. 5 is a front view of frame sections connected together, in accordance with some embodiments.

FIG. 5 shows an example of frame sections 402 having a different configuration of connection element. Three frame sections 402 are shown in this example. Connection element 440*c* on lateral edge 414 is configured as a bar that is spaced apart from and parallel to the lateral edge 414. Connection element 440*d* on the opposite lateral edge 416 is a tab with a rounded end that can hook around the bar of connection element 440*c*. Although two connection elements 440*d* are shown on an edge in this embodiment for attaching to the bar of connection element 440*d*, in other embodiments a single long connection element 440*d* or more than two connection elements 440*d* may be utilized. Moreover, in another example, some frame sections in a modular frame assembly may be configured with bar-shaped connection element(s) 440*c* on both lateral edges 414 and 416, while other frame sections in the modular frame assembly are configured with the hooking connection element(s) 440*d* on both lateral edges 414 and 416 (i.e., some frame sections serving as male connectors and other frame sections being female connectors). The pin 470 may be inserted at the joint area 480 such as via a through-hole in the connection elements as illustrated in FIG. 4A. In other examples, there need not be a through-hole in the connection elements. Instead, pin 470 may be coupled to the joint area 480 by other means such as by being inserted into a recessed area in the top of connection element 440*c*, or being adhered to the connection element 440*c*, such as by an adhesive or solder.

In further embodiments, other types of mechanisms can be used for connection elements between frame sections. Examples include but are not limited to features that snap together or slide together (e.g., a feature shaped to slide into a groove on the neighboring frame section). In some embodiments, the connection element can be a fastening component that is separate from the frame section, such that the end use product that utilizes the frame section does not need to include the connection element. For example, the connection element may be a clamp, tie or bracket that connects frame sections together in a releasable manner.

In some examples, the touch spinning system may include a plurality of syringes. Multiple syringes may be used whether there is one pin on a modular frame, or multiple pins on a modular frame. Having more than one syringe dispensing polymer solution may increase the efficiency of manufacturing by producing more fibers at once. Each syringe of the plurality of the syringes may be positioned such that at least one of the pins from one of the frame sections of the plurality of frame sections contacts a droplet dispensed from one of the syringes when the modular frame is rotated. For example, various pins of the modular frame may have different rotation paths, and one or more syringes may be positioned to coincide with each of the rotation paths so that all the pins can be utilized to form fibers from droplets of the syringes. In another example, various pins of the modular frame may have different heights at which they extend from the frames, and one or more syringes may be positioned (e.g., at different distances and different radial positions relative to the rotation axis) to coincide with the different pins.

Figure 6:
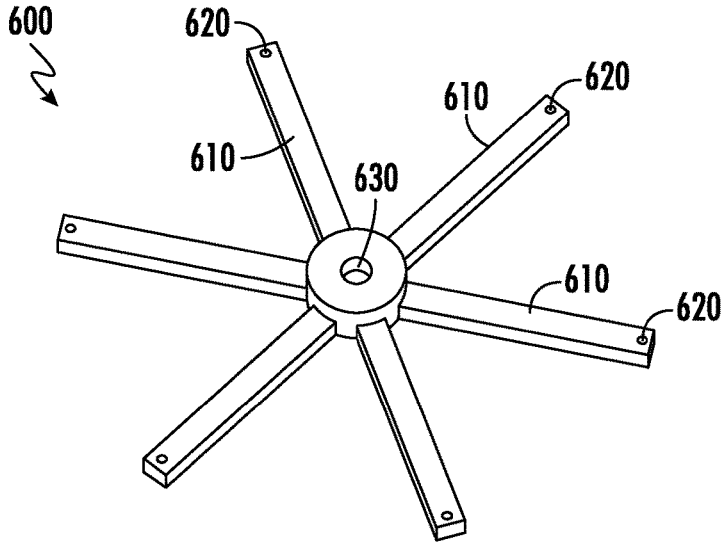
FIG. 6 is an isometric view of a support base for a modular frame, in accordance with some embodiments.

FIG. 6 is an isometric view of a base 600 on which a modular frame can be mounted for spinning during fiber fabrication, in accordance with some embodiments. Base 600 acts as support for a modular frame containing multiple frame sections. In this embodiment, the base 600 has six arms 610 that extend radially from a center 630 of the base 600. The six arms 610 accommodate a hexagonal ring of six frame sections such as the modular frame 400 of FIG. 4B. In other embodiments, fewer or more than six arms 610 can be utilized according to the shape of the modular frame to be mounted.

Each arm 610 has a coupling feature 620 near an outward end, for attaching a frame section. The coupling feature 620 in this example is a hole through which a pin (e.g., pin 470 of FIG. 4B) can be inserted for linking frame sections. For example, referring back to FIG. 3, each pin 370 extends through the frame section 365 and the base 340 (which is embodied as a solid plate in FIG. 3), to connect frame sections to each other and the frame sections to the base. The pin may be further secured to the base 600 (or base 340) by an additional fastener (not shown) such as a locking nut, a clamp, and the like. In other embodiments, the coupling feature 620 may be configured differently from a through hole, whether connecting pins are used or not. For example, coupling feature 620 may be include a threaded hole, a seating groove, or a raised feature to mate with a corresponding recess in the frame. Coupling features 620 may be configured to allow the frame sections to be disconnected from each other and also to allow the frame sections to be removed from the base so that the frame sections can be utilized in an end product. In other embodiments, the frame sections can be coupled to the base 600 (or 340) without the use of a coupling feature 620, such as by clamps or brackets that hold a frame section onto the base.

The center 630 in FIG. 6 is configured for mounting to a rotation device (e.g., rotation device 345 of FIG. 3), such as a motor. The center 630 has a through-hole in this example, but in other embodiments can be a recessed hole (partially but not all the way through the thickness of the base 600).

In other embodiments, the base 600 may be attached to the rotation device in other ways, such as by attaching one or more arms 610 to the rotation device, either directly or through an intermediate mount such as a plate or a fixture.

Figure 7A:
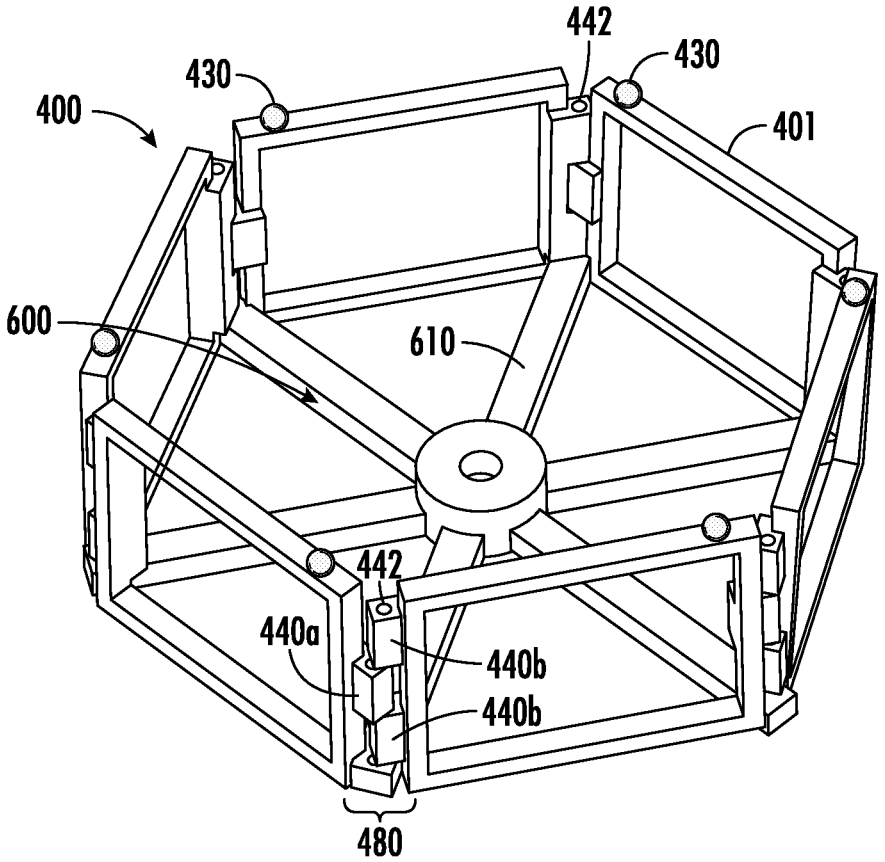
FIG. 7A is a perspective view of a modular frame on a support base, in accordance with some embodiments.
Figure 7B:
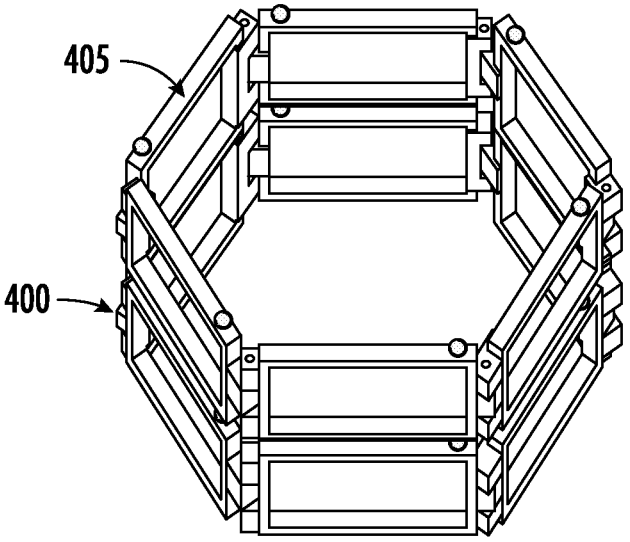
FIG. 7B is a perspective view of two modular frames stacked together, in accordance with some embodiments.

FIG. 7A is a plan view of the modular frame 400 from FIG. 4B mounted on support base 600 of FIG. 6). The frame sections 401 are shown in a partially assembled state to illustrate the features in the joint areas 480, including connections elements 440*a-b* and the through-holes 442 for pins 470 (not shown in this figure) to be inserted into. Arms 610 of support base 600 fit into the joint areas 480 in this example, to also be joined to the modular frame 400 by pins 470. Protrusions 430 on the top edges of the frame sections 401 allow for another ring of frame sections (a second modular frame 405) to be stacked on top of the modular frame 400, as shown in FIG. 7B (stacked but not fully interlocked, for illustrative purposes). In the case of FIG. 7B where second modular frame 405 is added onto the modular frame 400, the pins 470 would extend through modular frame 400 and past the top edges of the upper ring (second modular frame 405) to serve as a touch component during a spinning process.

Figure 8:
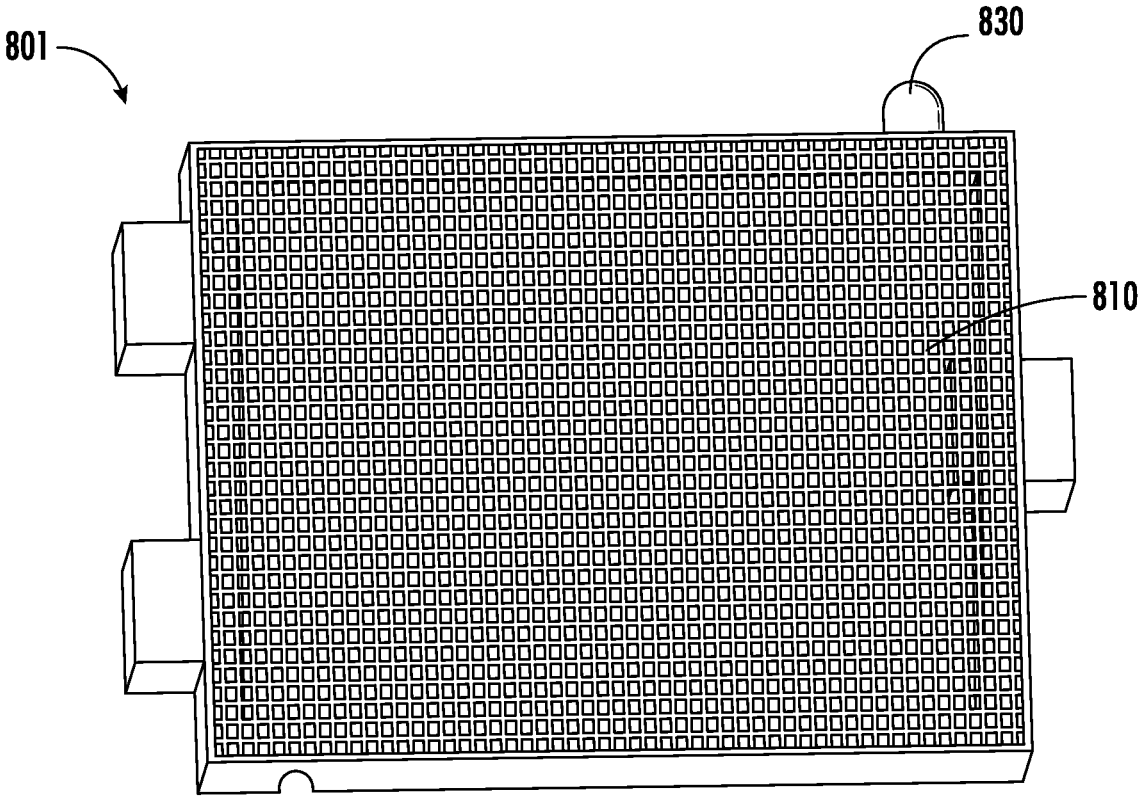
FIG. 8 is a front view of a frame section having a mesh, in accordance with some embodiments.

FIG. 8 is a front view of another embodiment of a frame section 801 that includes a mesh 810 (e.g., a screen). A protrusion 830 is also shown, similar to protrusion 430 of FIG. 4A. The mesh 810 can serve as a supportive backing for the fibers when they are spun onto the frame section 801. In some cases, the mesh 810 can be included as needed based on the size of the frame and/or size of the fibers being spun. For example, thinner fibers spun onto larger frames may benefit from having the mesh 810 as a backing to support the fibers as they are deposited. In some cases, the mesh 810 can be included according to requirements of the end-use product, such as air flow or $CO_2$ sorbent devices that require a particular mesh to be present. The mesh 810 may be configured as an orthogonal grid as shown in FIG. 8 or may be configured in other patterns such as parallel lines without intersecting lines (e.g., where the parallel lines are perpendicular to the rotation path so that the fibers are laid across the mesh lines), or as a hexagonal cell pattern. Example mesh materials include, for example, metals such as copper, aluminum, or other materials, or plastics such as polyethylene, polypropylene or other polymers. In some examples, the mesh material may supplement the properties of the desired end product, such as providing sorbent properties for the frame section/fiber mat being used as a sorbent component of an air flow device.

The mesh can have different hole sizes or porosity in different cases. In some cases, the mesh has large holes, similar to those of the mesh shown in FIG. 8, which allow air to easily pass through the mesh. In other cases, the mesh can have smaller holes (e.g., can be a denser fabric) which are less easy for air to pass through. In yet other cases, a solid sheet (e.g., without holes, or with microscopic or nanoscale holes) can be used to span the frame, and the fibers can be deposited on one or both sides of the sheet.

Figure 9A:
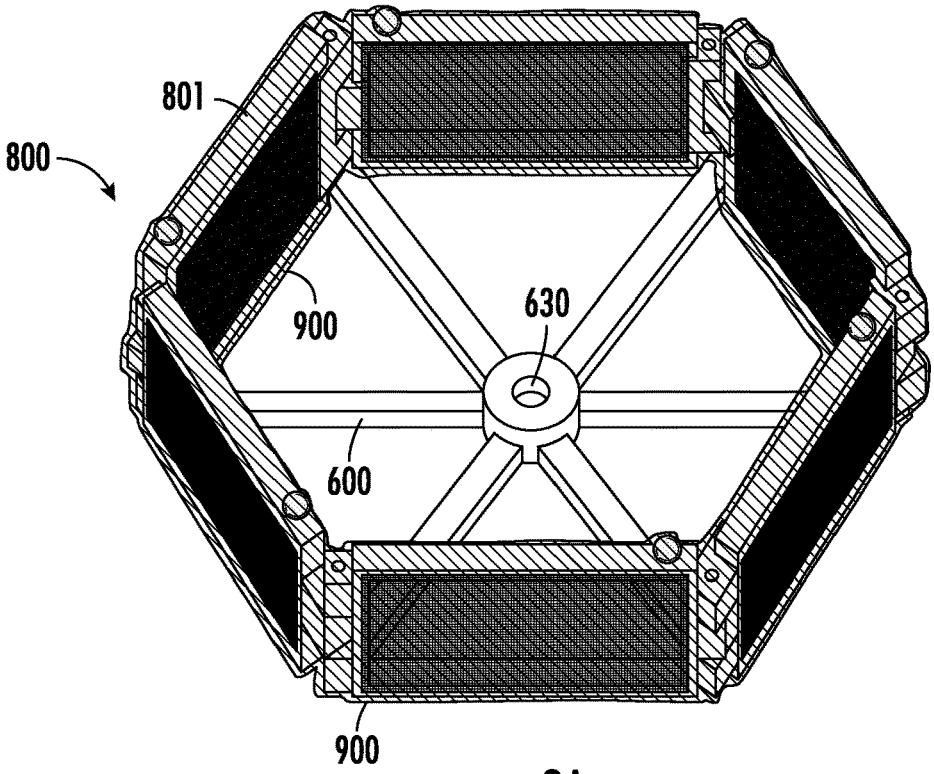
FIG. 9A is a perspective view of a modular frame with fibers spun onto it, in accordance with some embodiments.
Figure 9B:
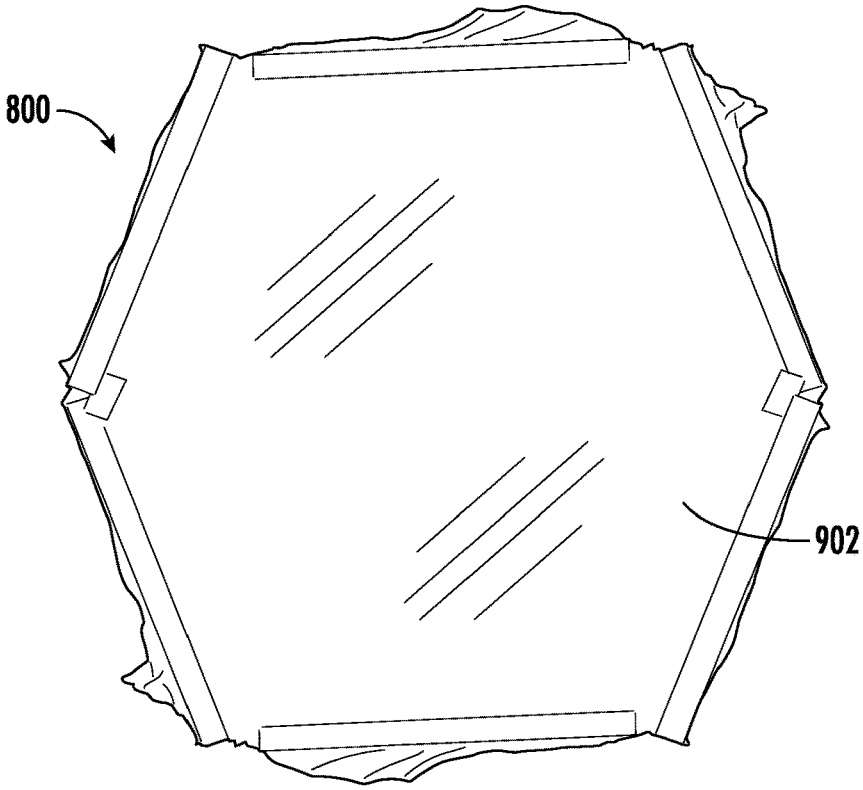
FIG. 9B is a top view of a modular frame with fibers spun across a top area of the modular frame, in accordance with some embodiments.

FIG. 9A is a perspective view of a modular frame 800 comprised of six frame sections 801 mounted on base 600, with fibers 900 spun onto the modular frame 800. In this illustration, the fibers 900 cover both the inner surfaces (facing toward the center 630 of the base 600) and outer surfaces (away from the center 630 of the base 600) of the frame sections 801. In other embodiments, the touch spinning process can be set up to coat only the inner or the outer surfaces. In one example, directing fibers to an inner or outer surface of the frame sections may be achieved by tailoring the position of the tips of the pins, such as angling the tips (e.g., tip 372 of FIG. 3, where a straight end of the pin opposite of the angled end is inserted into the connection elements) toward the inner or outer surfaces of the frame sections 801. FIG. 9B shows an embodiment in which fibers are spun across the top span surrounded by the modular frame 800, which is a hexagonal space in this illustration, to form a fiber mat 902. Fiber mat 902 can be used as an end product as-formed with the hexagonal modular frame 800, or the fiber mat 902 may be removed from the modular frame 800 and used on its own.

Figure 9C:
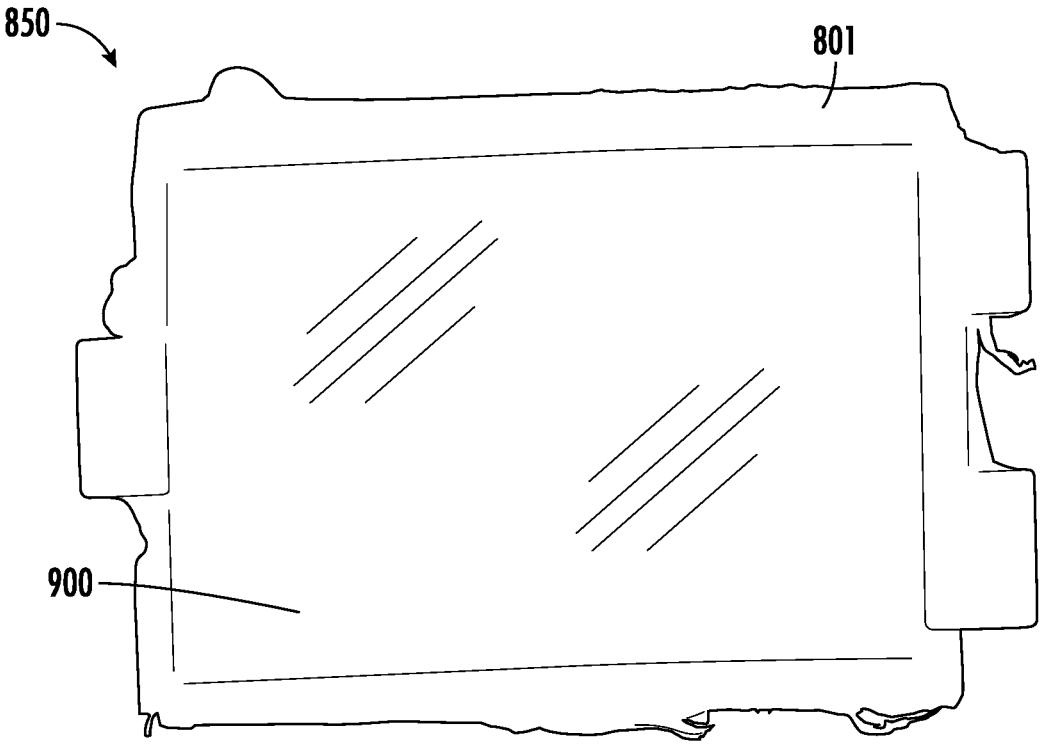
FIG. 9C is a front view of a frame section with fibers on it that may be used as a fiber component of an air flow device, in accordance with some embodiments.

Because of the modularity of the frame sections that are able to be coupled and decoupled from each other, the frame sections can be in a first arrangement during touch spinning and then reconfigured into a second arrangement different from the first arrangement after spinning. As an example, the hexagonal arrangement of frame sections 801 in FIG. 9A is a first arrangement that can be used to directly spin fibers onto the modular frame 800. After spinning, the frame sections 801 (with deposited fibers) can be decoupled from each other or rearranged in other manners to be used in an end-use application. FIG. 9C shows a fiber component 850 that comprises a single frame section 801 with fibers 900 on it. Single frame section 801 has been reconfigured from the hexagonal arrangement that was used during spinning, where in this example the frame section 801 has been disconnected from all other frame sections (e.g., by removing pins from the joint areas) and detaching connection elements from each other) in the modular frame 800. The single frame section is a second arrangement of the modular frame 800. In various examples, the second arrangement comprises at least one frame section of the plurality of frame sections being disconnected from the other frame sections. Examples of reconfigured arrangements of frame sections include: all of the frame sections being separated from each other, or some of the frame sections being connected in subgroups (e.g., pairs or triplets of frame sections arranged as needed, such as linearly or folded on to each other), or an edge of one frame section being disconnected such that all of the frame sections remain connected as a chain (e.g., to be positioned linearly or flat, or folded on top of each other, or arranged in a geometry to fit into an air flow device). This modularity in being able to rearrange the frame sections for various end-use applications enables the fiber components (fiber mat on frame) to be manufactured in a universal fashion (although also customizable) while being flexible in their configuration for an end product.

Figure 10A:
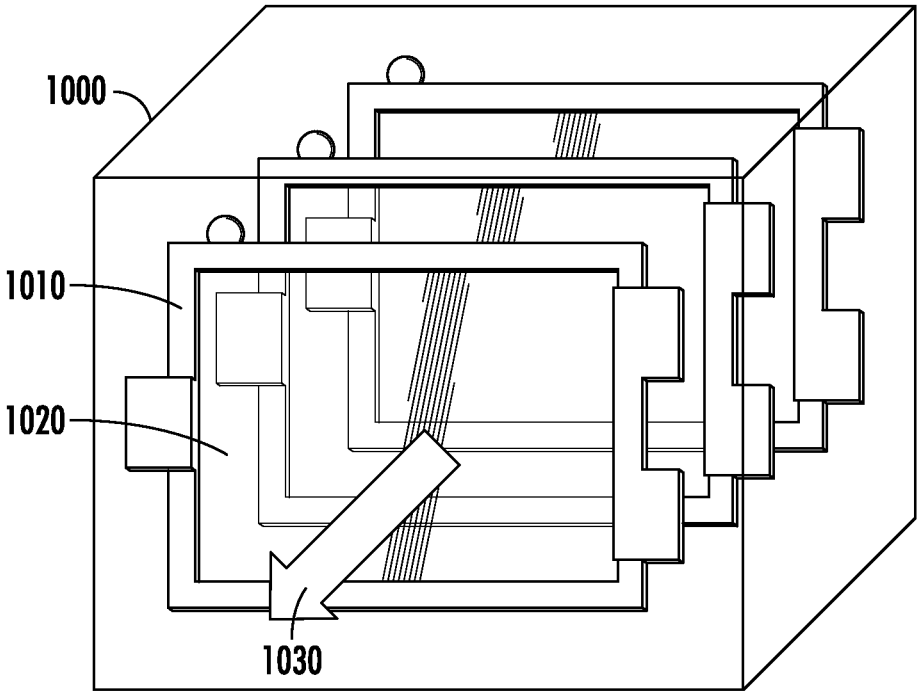
FIGS. 10A-10B are isometric views of frame sections reconfigured after touch spinning, in accordance with some embodiments.
Figure 10B:
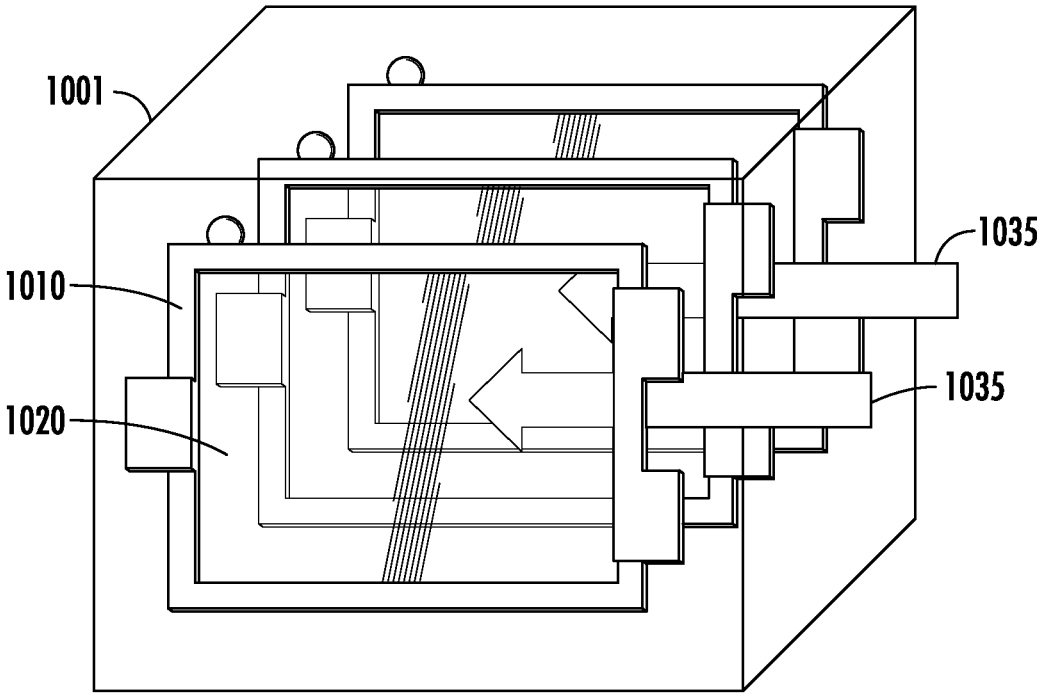

FIGS. 10A-10B show examples of reconfiguring a plurality of frame sections into a second arrangement after touch spinning, different from a first arrangement as when the frame sections are mounted on a base during touch spinning. In FIG. 10A, individual frame sections 1010 that are coated with fiber mats 1020 are arranged parallel to each other in an air flow device 1000 (shown schematically as a box for illustrative purposes), perpendicular to the direction of air flow. The direction of air flow is represented by arrow 1030. In FIG. 10B, the individual frame sections 1010 coated with fiber mats 1020 are arranged parallel to each other in an air flow device 1001, parallel to the direction of air flow as represented by arrows 1035. In the examples of FIG. 10A-10B, single frame sections 1010 are used as individual units. In other cases, two or more frame sections can be used together (e.g., linked, connected) in an end product. For example, the frame sections may be angled, stacked, or otherwise oriented in a different geometric configuration than during rotation for touch spinning.

Figure 11A:
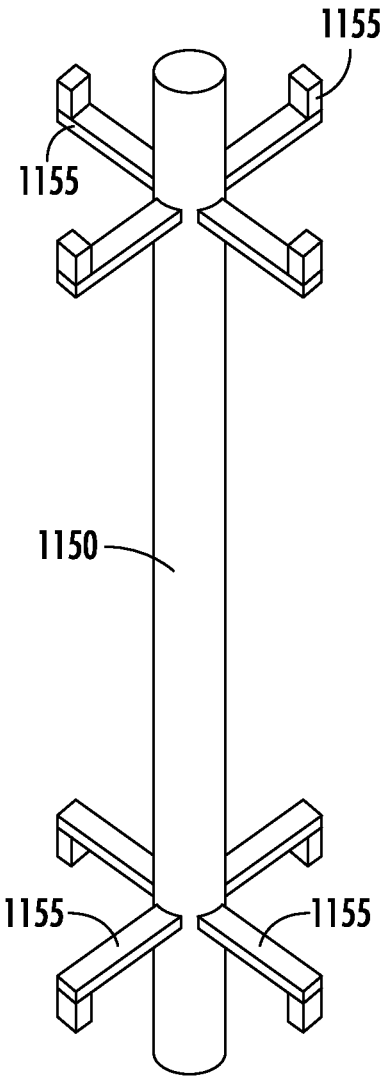
FIGS. 11A-11B are isometric views of a support structure and modular frames on the support structure, in accordance with some embodiments.
Figure 11B:
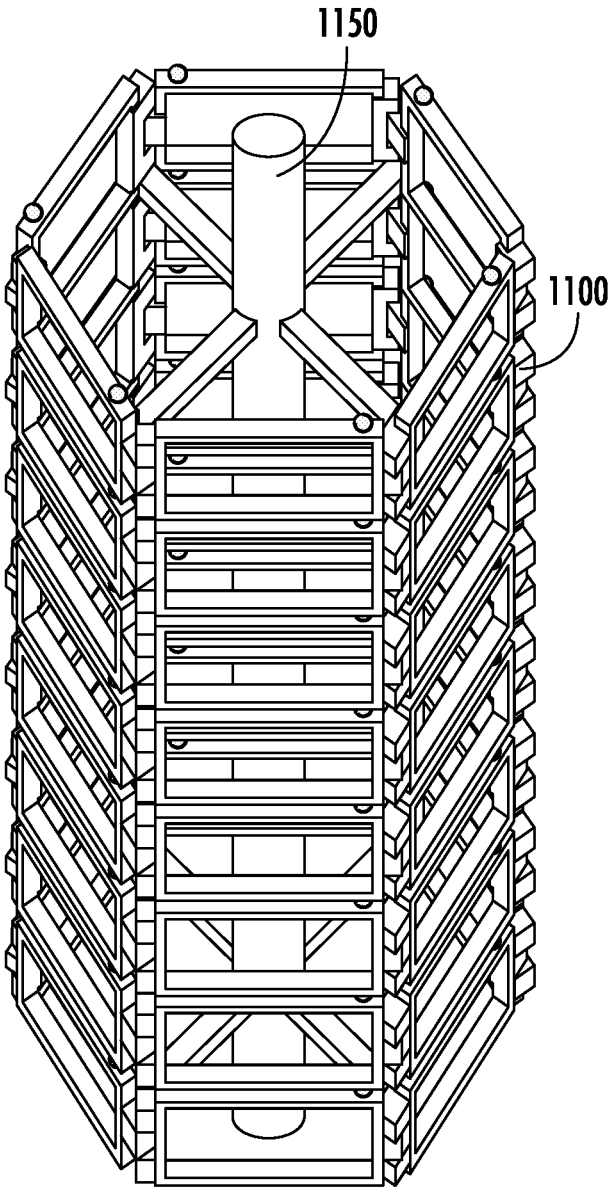

FIGS. 11A-11B provide isometric views of an example in which the modular frames themselves are used in a modular fashion. In FIG. 11A, a post 1150 (i.e., a pole or beam) with hooks 1155 extending radially outward serves as a support structure. In this example, one group of hooks 1155 is near a first end of post 1150, and a second group of hooks 1155 is near a second end opposite the first end. In FIG. 11B, multiple modular frames 1100 are stacked on each other after having fibers laid onto them during touch spinning. The modular frames 1100 are hexagonal in this example. The post 1150 runs through the middle a stack of modular frames 1100 which attach to the hooks 1155. The stacked frames 1100 form a larger structure, which is a reconfigured arrangement compared to one modular frame 1100 during touch spinning. The protrusions that are present on the frame sections of the modular frames 1100 may be utilized to secure the stacked frames together by having the protrusions fit into a mating recess (e.g., notches as described herein) on a bottom edge of the modular frame above it. Other numbers of modular frames 1100 may be stacked rather than the eight modular frames 1100 shown. In another example, the modular frames 1100 can be stacked horizontally, with the post 1150 and the entire stack of modular frames 1100 lying horizontally. In some cases, multiple modular frames 1100 and the support structure (post 1150) can be a component of an air flow device. For example, multiple modular frames 1100 and the support structure can be a $CO_2$ sorbent component of an air flow device.

In some aspects of the present disclosure, a system for touch spinning includes a modular frame having a plurality of frame sections. The system may be, for example for forming a fiber component of an air flow device. The system may include a modular frame, a base, a rotation device, and a syringe. The modular frame has a plurality of frame sections, wherein frame sections of the plurality of frame sections are connectable to each other by a connection element at a joint area. The system includes a pin extending from the joint area, near a top edge of the modular frame. The base is configured to be coupled to the modular frame at a bottom edge of the frame section, the bottom edge being opposite the top edge. For example, the modular frame can be coupled to the base by pins and through-holes, clamps, or other mechanisms as described herein. The rotation device is configured to be coupled to the base, such as via a hole in the base or other mechanisms as described herein. The syringe is positioned such that the pin passes by and contacts a droplet dispensed from the syringe when the base and the modular frame are rotated by the rotation device.

In some aspects, a protrusion is on a first edge of a frame section of the plurality of frame sections, and a notch is on a second edge of the frame section. The second edge is opposite the first edge, wherein the protrusion is configured to fit into the notch. In some aspects, the modular frame comprises frame sections of the plurality of frame sections stacked together, with the protrusion inserted into the notch. In some aspects, the connection element comprises a tab coupled to a lateral edge of the frame section, the tab having a through-hole parallel to the lateral edge. In some aspects, the system the pin is insertable into the through-hole of the tab to connect adjacent frame sections of the plurality of frame sections to each other. In some aspects, the base comprises a hole in the base, wherein the pin is also inserted through the hole in the base to couple the plurality of frame sections to the base. In some aspects, the system includes a plurality of the pins extending from a plurality of the joint areas. In some aspects, each frame section comprises a mesh across an open space of the frame section, between the bottom edge and the top edge. In some aspects, the system comprises a plurality of the syringes, wherein each syringe of the plurality of the syringes is positioned such that at least one of the pins of the plurality of the pins contacts the droplet dispensed from the syringe when the rotation device rotates the base and the modular frame.

Figure 12:
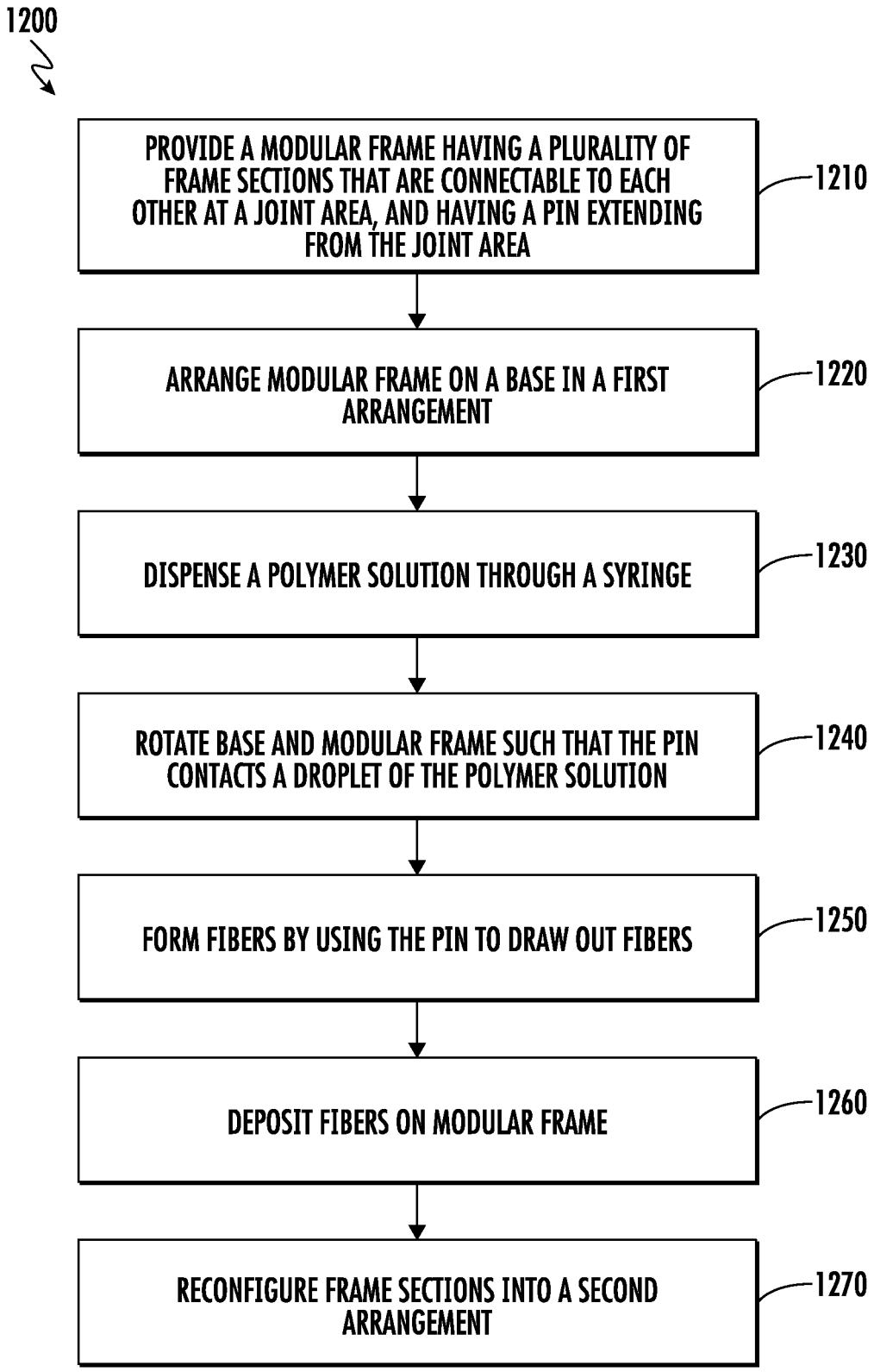
FIG. 12 is a flowchart representing example methods for touch spinning, such as for forming a fiber component of an air flow device, in accordance with some embodiments.

FIG. 12 is a flowchart of an example method 1200 for touch spinning, such as a method of forming a fiber component of an air flow device, in accordance with some embodiments. In block 1210, a modular frame that comprises a plurality of frame sections is provided. Adjacent frame sections of the plurality of frame sections are connectable to each other at a joint area, and wherein a pin extends from the joint area of the modular frame. Block 1220 involves arranging the modular frame on a base in a first arrangement of the plurality of frame sections. Block 1230 involves dispensing a polymer solution through a syringe. Block 1240 involves rotating the base and the modular frame such the pin passes by and contacts a droplet of the polymer solution as the modular frame rotates. Fibers are formed in block 1250 by using the pin to draw out the fibers from droplet of the polymer solution. In block 1260, the fibers are deposited on the modular frame. In block 1270, after the depositing, the plurality of frame sections are reconfigured into a second arrangement different from the first arrangement to form the fiber component of the air flow device.

Examples of materials that can be spun into fibers by the methods and systems described herein include polymers, such as polyester, polyethylene, poly(hydroxyalkanoate), poly(lactic acid), poly(ε-caprolactone), or poly(ethylene terephthalate. In some cases, the fiber material is biodegradable and/or is bioproduced (e.g., produced from renewable biomass sources, such as vegetable fats and oils, corn starch, straw, woodchips, sawdust, recycled food waste, etc.). For example, the touch spun fiber materials can be made from a biodegradable polymer (e.g., poly(lactic acid) (PLA) or polyester).

Embodiments of the method 1200 can include variations of components and techniques described herein, and any combinations thereof. For example, the modular frame and frame sections provided in block 1210 may incorporate various numbers and/or locations of protrusions, various numbers and/or locations of pins, and various configurations of connection elements (e.g., described in relation to FIGS. 4A and 5). In block 1220, the arrangement of the modular frame may include various numbers of frame sections arranged in different ring configurations or in arrangements of one or more individual, unconnected frame sections.

In embodiments of the method 1200, aspects of the touch spinning process may be customized to achieve desired specifications of the manufactured fibers. For example, in blocks 1230, 1240 and 1250, aspects to be controlled may include properties of the polymer solution (e.g., the type of polymer, polymer blend, the viscosity, concentration), a rate at which the polymer solution is dispensed through the syringe, and/or the speed of rotation of the frame. These aspects may be controlled to change characteristics (e.g., nanofiber diameter, mat density, etc.) of the produced fibers and of a mat made of the fibers on the frame sections. Block 1260 of depositing fibers may also include aspects that can be customized to the particular application, such as varying the speed of rotation of the modular frame (and base), or directing the fibers onto an inner or outer surface of the frame or across a span of the modular frame (e.g., as shown in FIG. 9B).

Systems and methods described herein provide a modular structure that enables touch spinning multidimensional structures. Instead of using a touch component and separate collection component, embodiments use pins that are incorporated onto frame sections. The frame sections are connectable to form a modular frame, and fibers are directly collected onto the frame sections. The frame sections are reconfigurable into different arrangements, such as having one configuration during touch spinning and a different configuration in a final product. Embodiments can include touch spinning onto each individual frame section, and then assembling a "superstructure" of multiple frame sections afterwards. This allows for flexibility and modularity not achieved by the prior art.

In some aspects of the method 1200, the fibers are nanofibers. In some aspects, a protrusion on a first edge of a frame section of the plurality of frame sections, and a notch on a second edge of the frame section, the second edge opposite the first edge, wherein the protrusion is configured to fit into the notch. In some aspects, the method and corresponding system further comprises a plurality of the pins extending from a plurality of the joint areas, wherein each pin of the plurality of the pins is used in forming the fibers. In some aspects, at least one frame section of the plurality of frame sections comprises a connection element configured to connect the adjacent frame sections of the plurality of frame sections to each other at the joint area. In some aspects, the connection element is configured with a through-hole to receive the pin to connect the adjacent frame sections to each other. In some aspects, the first arrangement comprises the plurality of frame sections connected in a ring, and the rotating causes the pin to move in a path that intersects a location of the droplet. In some aspects, the second arrangement comprises at least one frame section of the plurality of frame sections being disconnected from the other frame sections in the plurality of frame sections. In some aspects, each frame section further comprises a mesh across an open space within the frame section, and the fibers are deposited on the mesh and the frame section. In some aspects, the fiber component of the air flow device comprises a frame section and a mat of the fibers on the frame section. In some aspects, the fiber component is a sorbent for the air flow device. In some aspects, the air flow device is a carbon dioxide capture system.

In some cases, methods may include some but not all of the blocks of the flowchart of FIG. 12. In an example, method 1200 may be a method of touch spinning fibers. In this example, block 1210 involves providing a modular frame that comprises a plurality of frame sections, wherein frame sections of the plurality of frame sections are releasably connectable to each other by a connection element at a joint area of the modular frame, and wherein a pin extends from the joint area. Block 1230 involves dispensing a polymer solution through a syringe. Block 1240 involves rotating a base with the modular frame coupled onto the base such the pin passes by and contacts a droplet of the polymer solution as the modular frame rotates. Block 1250 involves forming a fiber component of an air flow device, the fiber component comprising a frame section of the plurality of frame sections and a mat of fibers, the fibers drawn out from droplets of the polymer solution by the pin in the modular frame and deposited on the frame section.

In some aspects, methods may include reconfiguring the plurality of frame sections from a first arrangement in the rotating to a second arrangement after the depositing. In some aspects, the second arrangement comprises at least one frame section of the plurality of frame sections being disconnected from other frame sections in the plurality of frame sections. In some aspects, methods further include controlling a speed of the rotating or a rate of dispensing the polymer solution, to control a characteristic of the fibers. In some aspects, methods further include tailoring a location or number of the pins to control a configuration of the fibers deposited on the frame section. In some aspects, methods and corresponding systems include a protrusion on a first edge of a frame section of the plurality of frame sections, and a notch on a second edge of the frame section, the second edge opposite the first edge, wherein the protrusion is configured to fit into the notch. In some aspects, the connection element comprises a tab coupled to a lateral edge of the frame section, the tab having a through-hole parallel to the lateral edge. In some aspects, methods further include inserting the pin into the through-hole of the tab to connect adjacent frame sections of the plurality of frame sections to each other.

In embodiments, a frame section with fibers deposited on it (e.g., as a nanofiber mat) may be utilized as a fiber component of an airflow device. In one example, a nanofiber mat is a sorbent that captures carbon dioxide ($CO_2$) from ambient air, for example, from air within a building. In some cases, the manufactured fiber components described herein can beneficially be incorporated into existing heating, ventilation and air conditioning (HVAC) systems. The fibers provide a large surface area for adsorbing substances such as $CO_2$.

For example, the frame sections with fibers deposited on them, as described herein, can be used in an air flow system that is a $CO_2$ capture system in which $CO_2$ is captured and then converted into a converted material (e.g., a carbonate salt) that can be collected. The converted material containing the captured $CO_2$ can then be disposed of or used in another application. In such systems, ambient carbon dioxide capture and conversion include receiving an intake air stream (e.g., diverted ambient airflow from existing ventilation ducts of a building), and using a sorbent for capturing $CO_2$ from the intake airstream, where the sorbent material is housed in a mechanical fixture. In some cases, the mechanical fixture is configured to move the sorbent through (or into and out of) various components (e.g., a reaction vessel) within the system. For example, the mechanical fixture can be motorized.

The touch spun fibers described herein can be used in a $CO_2$ sorbent of a $CO_2$ capture system, and can include any material that captures (e.g., by adsorption) $CO_2$. The sorbent can also reversibly capture $CO_2$ (e.g., by adsorption) such that the $CO_2$ can be released (e.g., desorbed) from the sorbent. In some cases, the sorbent includes the touch spun fibers on a frame described herein. In some cases, the sorbent includes a fiber mat with a high surface area (e.g., greater than 500 $m^2/g$, or from 600 $m^2/g$ to 2000 $m^2/g$). In some cases, the sorbent includes a fiber mat with small diameter fibers (e.g., with diameters about 300 nm, or less than 1 micron, or less than 500 nm, or less than 100 nm, or from 100 nm to 1000 nm). The material of the fibers can be a polymer, such as polyethylene. In some cases, the fibers of the sorbent are biodegradable and/or are bioproduced (e.g., produced from renewable biomass sources, such as vegetable fats and oils, corn starch, straw, woodchips, sawdust, recycled food waste, etc.). For example, the sorbent can include the touch spun fibers described herein, which can be made from a biodegradable polymer (e.g., poly(lactic acid) (PLA) or polyester). In some cases, the sorbent can include fibers comprising polyester, polyethylene, poly(hydroxyalkanoate), poly(lactic acid), poly(ε-caprolactone), or poly (ethylene terephthalate).

The systems and methods herein enable components involving fibers on frames to be fabricated in an efficient and modular manner. In some examples, the fiber components (frame with fibers deposited onto it) can be used as an air flow component in an air flow device, such as sorbent for a carbon dioxide capture system. An airflow frame for an air flow sorbent material has different requirements from, for example, a biological scaffold because air flow materials are used as a stand-alone component whereas biological scaffolds are meant to support growing tissue. Therefore, the mechanical properties of the fibers required of an air flow component would be different from other conventionally touch-spun components such as biological scaffolds.

Reference has been made in detail to embodiments of the disclosed invention, one or more examples of which have been illustrated in the accompanying figures. Each example has been provided by way of explanation of the present technology, not as a limitation of the present technology. In fact, while the specification has been described in detail with respect to specific embodiments of the invention, it will be appreciated that those skilled in the art, upon attaining an understanding of the foregoing, may readily conceive of alterations to, variations of, and equivalents to these embodiments. For instance, features illustrated or described as part of one embodiment may be used with another embodiment to yield a still further embodiment. Thus, it is intended that the present subject matter covers all such modifications and variations within the scope of the appended claims and their equivalents. These and other modifications and variations to the present invention may be practiced by those of ordinary skill in the art, without departing from the scope of the present invention, which is more particularly set forth in the appended claims. Furthermore, those of ordinary skill in the art will appreciate that the foregoing description is by way of example only and is not intended to limit the invention.

What is claimed is:

1. A method of forming a fiber component of an air flow device, the method comprising:

providing a modular frame that comprises a plurality of frame sections, wherein adjacent frame sections of the plurality of frame sections are connectable to each other at a joint area, and wherein a pin extends from the joint area of the modular frame;

arranging the modular frame on a base in a first arrangement of the plurality of frame sections;

dispensing a polymer solution through a syringe;

rotating the base and the modular frame such the pin passes by and contacts a droplet of the polymer solution as the modular frame rotates;

forming fibers by using the pin to draw out the fibers from the droplet of the polymer solution;

depositing the fibers on the modular frame; and after the depositing, reconfiguring the plurality of frame sections into a second arrangement different from the first arrangement to form the fiber component of the air flow device.

2. The method of claim 1, wherein the fibers are nanofibers.

3. The method of claim 1, further comprising:

a protrusion on a first edge of a frame section of the plurality of frame sections; and a notch on a second edge of the frame section, the second edge opposite the first edge, wherein the protrusion is configured to fit into the notch.

4. The method of claim 1, further comprising a plurality of pins extending from a plurality of joint areas, wherein each pin of the plurality of pins is used in forming the fibers.

5. The method of claim 1, wherein at least one frame section of the plurality of frame sections comprises a connection element configured to connect the adjacent frame sections of the plurality of frame sections to each other at the joint area.

6. The method of claim 5, wherein the connection element is configured with a through-hole to receive the pin to connect the adjacent frame sections to each other.

7. The method of claim 1, wherein:

the first arrangement comprises the plurality of frame sections connected in a ring; and the rotating causes the pin to move in a path that intersects a location of the droplet.

8. The method of claim 1, wherein the second arrangement comprises at least one frame section of the plurality of frame sections being disconnected from other frame sections in the plurality of frame sections.

9. The method of claim 1, wherein each frame section of the plurality of frame sections further comprises a mesh across an open space within each frame section; and wherein the fibers are deposited on the mesh and each frame section.

10. The method of claim 1, wherein the fiber component of the air flow device comprises a frame section and a mat of the fibers on the frame section.

11. The method of claim 1, wherein the fiber component is a sorbent for the air flow device.

12. The method of claim 1, wherein the air flow device is a carbon dioxide capture system.

13. A method of touch spinning fibers, the method comprising:

providing a modular frame that comprises a plurality of frame sections, wherein frame sections of the plurality of frame sections are releasably connectable to each other by a connection element at a joint area of the modular frame, and wherein a pin extends from the joint area;

dispensing a polymer solution through a syringe;

rotating a base with the modular frame coupled onto the base such that the pin passes by and contacts a droplet of the polymer solution as the modular frame rotates; and forming a fiber component of an air flow device, the fiber component comprising a frame section of the plurality of frame sections and a mat of fibers, the fibers drawn out from droplets of the polymer solution by the pin in the modular frame and deposited on the frame section.

14. The method of claim 13, further comprising reconfiguring the plurality of frame sections from a first arrangement in the rotating to a second arrangement after the depositing.

15. The method of claim 14, wherein the second arrangement comprises at least one frame section of the plurality of frame sections being disconnected from other frame sections in the plurality of frame sections.

16. The method of claim 13, further comprising controlling a speed of the rotating or a rate of dispensing the polymer solution, to control a characteristic of the fibers.

17. The method of claim 13, further comprising tailoring a location or a number of pins to control a configuration of the fibers deposited on the frame section.

18. The method of claim 13, further comprising:

a protrusion on a first edge of at least one frame section of the plurality of frame sections; and a notch on a second edge of the at least one frame section, the second edge opposite the first edge, wherein the protrusion is configured to fit into the notch.

19. The method of claim 13, wherein the connection element comprises a tab coupled to a lateral edge of each of the frame sections, the tab having a through-hole parallel to the lateral edge.

20. The method of claim 19, further comprising inserting the pin into the through-hole of the tab to connect adjacent frame sections of the plurality of frame sections to each other.

* * * * *